US005083332A

United States Patent [19]

Foster et al.

[11] Patent Number: 5,083,332

[45] Date of Patent: Jan. 28, 1992

[54] HOSPITAL BED WITH COLLAPSIBLE SIDE EDGES AND LATERALLY-MOVABLE SIDE GUARDS

[75] Inventors: L. Dale Foster, Brookville, Ind.; James H. Breidenbach, Cincinnati, Ohio

[73] Assignee: Hill-Rom Company, Inc., Batesville, Ind.

[21] Appl. No.: 627,486

[22] Filed: Dec. 14, 1990

Related U.S. Application Data

[63] Continuation-in-part of Ser. No. 576,837, Sep. 4, 1990, which is a continuation-in-part of Ser. No. 386,210, Jul. 28, 1989, Pat. No. 4,985,946.

[51] Int. Cl.[5] ..... A47C 19/04

[52] U.S. Cl. ..... 5/185; 5/181; 5/481; 5/450; 5/60

[58] Field of Search ..... 5/60, 66, 185, 181, 5/184, 175, 481, 450, 465

[56] References Cited

U.S. PATENT DOCUMENTS

| | | | |
|---|---|---|---|
| 2,284,470 | 5/1942 | Comper et al. . | |
| 2,786,214 | 3/1957 | Armstrong . | |
| 3,064,278 | 11/1962 | Broyles | 5/184 |
| 3,335,432 | 8/1967 | Foster | 5/181 |
| 3,518,786 | 7/1970 | Holtvoigt | 5/481 |
| 3,585,660 | 6/1971 | Gottfried | 5/60 |
| 3,930,273 | 1/1976 | Stern . | |
| 3,958,283 | 5/1976 | Adams et al. . | |
| 4,002,330 | 1/1977 | Johansson . | |
| 4,206,525 | 6/1980 | Williams . | |
| 4,287,620 | 9/1981 | Zur | 5/465 |
| 4,486,908 | 12/1984 | Schroeder . | |
| 4,669,136 | 6/1987 | Waters et al. . | |
| 4,747,171 | 5/1988 | Einsele et al. . | |
| 4,941,221 | 7/1990 | Kanzler | 5/60 |
| 4,987,623 | 1/1991 | Stryker | 5/185 |
| 5,027,458 | 7/1991 | Osczevski | 5/481 |

FOREIGN PATENT DOCUMENTS

| | | | |
|---|---|---|---|
| 931328 | 8/1955 | Fed. Rep. of Germany | 5/481 |
| 189572 | 12/1922 | United Kingdom . | |

*Primary Examiner*—Gary L. Smith
*Assistant Examiner*—Flemming Saether
*Attorney, Agent, or Firm*—Wood, Herron & Evans

[57] ABSTRACT

A hospital bed has a frame mounted on a base. Articulating head, seat and leg patient support panels are mounted on the frame. Side guards are mounted on the panels. Patient support panels have longitudinal edges that are collapsible to narrow the bed for transporting a patient. The side guards are inwardly movable to contribute to the narrowing of the bed while still protecting the patient from falling out of the bed.

4 Claims, 3 Drawing Sheets

HOSPITAL BED WITH COLLAPSIBLE SIDE EDGES AND LATERALLY-MOVABLE SIDE GUARDS

BACKGROUND OF THE INVENTION

This is a continuation-in-part of application Ser. No. 07/576,837, filed Sept. 4, 1990, which is a continuation-in-part of application Ser. No. 07/386,210, filed July 28, 1989 now U.S. Pat. No. 4,985,946.

This invention relates to a hospital bed that is convertible between a full size hospital bed that is about 42 inches in width and a narrow stretcher or transport cart that is about 34 inches in width.

A hospital bed has a base with casters on it so that it can be moved about. A frame is mounted on the casters for movement between low and high positions. At least two, and preferably three, patient support panels are mounted on the frames, and power systems are provided to articulate the patient support panels with respect to each other so as to change the patient support structure to permit the patient to sit up, lie down or assume positions inbetween to accommodate the patient's needs and comfort.

SUMMARY OF THE INVENTION

An objective of the present invention is to provide a bed that can be either a full size bed with all of the attendant comforts of the full size bed, or a narrow 34-inch width stretcher size bed, the bed being narrowed for the specific purpose of transporting a patient from place to place.

Such a bed, convertible between full size and narrow stretcher size, makes possible the convenient maintaining of a patient in one bed as he is transported to and from rooms other than the patient's room for performing diagnostic procedures. Such a convertible bed eliminates the trauma of shifting a patient from bed to stretcher. If, however, transfer from the bed to an operating room table or similar structure is necessary, the patient is more conveniently in reach of the attending nurses if the bed is narrowed to 34 inches, thereby minimizing the strain of leaning over a wide bed to transfer the patient from bed to another support.

The objective of the invention is attained by forming patient support panels and mattress with collapsible longitudinal side sections. Each side section, when collapsed, narrows the side by about 4 inches. Side guards are movable inwardly 4 to 5 inches on each side of the bed to create a stretcher width bed with full side guard protection. In a preferred form of the invention, each side section is constructed of a rigid backing strip that normally is coplanar with the patient support panel. An inflatable mattress tube, preferably of rectangular cross section, is mounted on the backing strip. An air transfer system is provided for inflating the mattress tubes. Deflating may be accomplished simply by exhausting air to atmosphere, or alternatively, deflating can be assisted by a pneumatic pump.

The rigid backing strips are hinged to the patient support panels and are pivotable upwardly while the mattress tubes deflate. The backing strips compress the deflated mattress tubes flat between the strips and the main mattress sections, thus narrowing the patient support panel by about 4 inches on each side.

The present invention contemplates at least two embodiments, the embodiments differing in the manner in which side guards are mounted on the bed.

The first embodiment has on each side a head end side guard and a foot end side guard. The head, seat and leg panels each have collapsible side sections to narrow the bed along its complete length. The side guards are mounted so as to move into the space left vacant by the collapsed side sections. See copending application Ser. No. 07/386,210, filed July 28, 1989, which is incorporated herein by reference.

In this first embodiment, narrowing for patient transport is effected by collapsing the side sections all along the length of the bed and moving the head and foot side guards into the spaces vacated by the collapsed head and foot side sections.

In the second embodiment, a single long (sometimes referred to as "three quarter") side guard is mounted on each side of the bed. The side guard is supported on two vertical posts mounted adjacent the seat panel. The seat panel has no collapsing side sections, although the head and foot panels do have collapsing side sections. At the seat panel, the mattress and panel are slotted to permit the side guards to slide inwardly to reduce the width dimension at the seat. At the head and leg panels, the collapsible side sections of the type described above reduce the width of the remainder of the bed.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE PREFERRED EMBODIMENT

Figure 1:
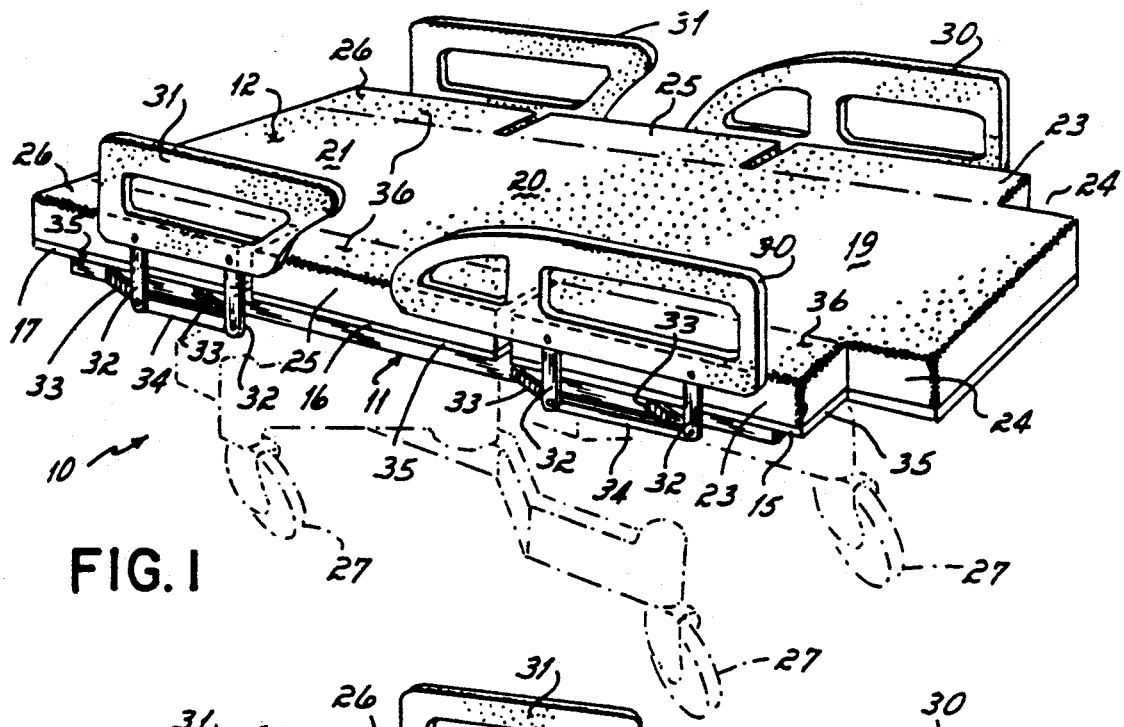
FIG. 1 is a diagrammatic perspective view of the bed of the present invention.

Referring to FIG. 1, there is depicted a bed 10 having a base 11 including a bed frame and a patient support surface 12 mounted on the base. The base has casters 27 so that the bed can be moved, stretcher-like, from place to place. The patient support system is formed by a head panel 15, a seat panel 16 and a leg or foot panel 17. The patient support panels 15, 16 and 17 have main mattress sections 19, 20, and 21, respectively. At the head panel, the mattress section 19 has collapsible side sections 23. The side sections preferably do not extend the full length of the mattress 19, thereby leaving corner notches 24 on each side of the head end of the bed. This permits a pivoting power column of the type disclosed in copending application Ser. No. 07/525,044, filed May 18, 1990, to swing tightly around the head end of the bed. The seat panel 16 has collapsible side sections 25 on each side. The leg panel 17 also has collapsible side sections 26 on each side of the panel.

Head end side guards 30 are mounted adjacent the head panel 15 alongside the collapsible side sections 23. Foot end side guards 31 are mounted alongside the foot end of the bed adjacent the collapsible side sections 26. The head and foot end side guards have vertical links 32 and horizontal links 33, both forming, with horizontal bar 34, parallelograms preferably constructed as disclosed in parent application Ser. No. 07/386,210, filed July 28, 1989. More particularly, side guards 31, links 32 and horizontal bar 34 form the parallelogram linkage for raising and lowering the side guard. Bar 34, links 33 and bed frame 11 form a second parallelogram linkage for moving the side guards transversely in and out to narrow and widen the bed. Their structure permits them to move transversely inwardly to occupy the space vacated by the collapsible sections 23, 25 and 26, respectively.

Figure 2:
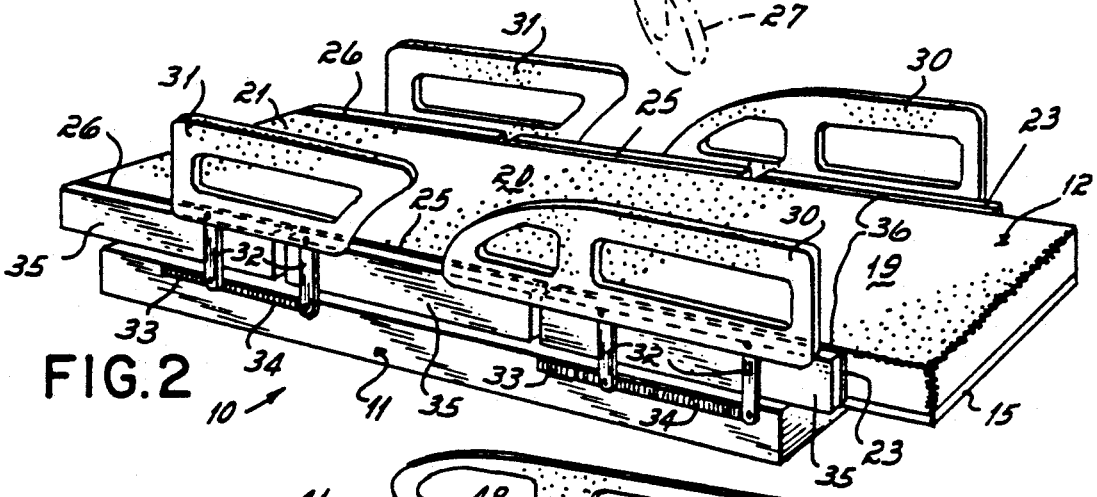
FIG. 2 is a diagrammatic perspective view of the bed of FIG. 1 showing the bed converted to a transport stretcher.

As shown in FIGS. 4–7, each collapsible section 23, 25, 26 is formed from a rigid strip 35 which is hinged to a respective patient support panel for upwardly-pivoting movement. In other words, the strip can pivot from the horizontal patient support position illustrated in FIGS. 1 and 4 to a vertical collapsed side section position shown in FIGS. 2 and 6. Mounted on each rigid strip is an inflatable mattress tube 36 which can be inflated to the condition shown in FIG. 1 where it can fully support a patient, or it can be collapsed, as shown in FIG. 2, permitting the rigid strips or wings to swing upwardly, thereby narrowing the bed.

In the operation of the invention, the bed is about 42 inches wide in the condition shown in FIG. 1 wherein the patient has the usual amount of room as, for example, a 34-inch wide patient support surface. The side guards 30 and 31 make the width about 42 inches. If a patient is to be transported, all of the side sections 23, 25 and 26 are collapsed with the strips 35 swung upwardly to narrow the patient support system to about 25 inches. The side guards are moved transversely inwardly to contribute to the narrowing of the bed to an overall width dimension of about 34 inches while continuing to protect the patient.

Figure 3:
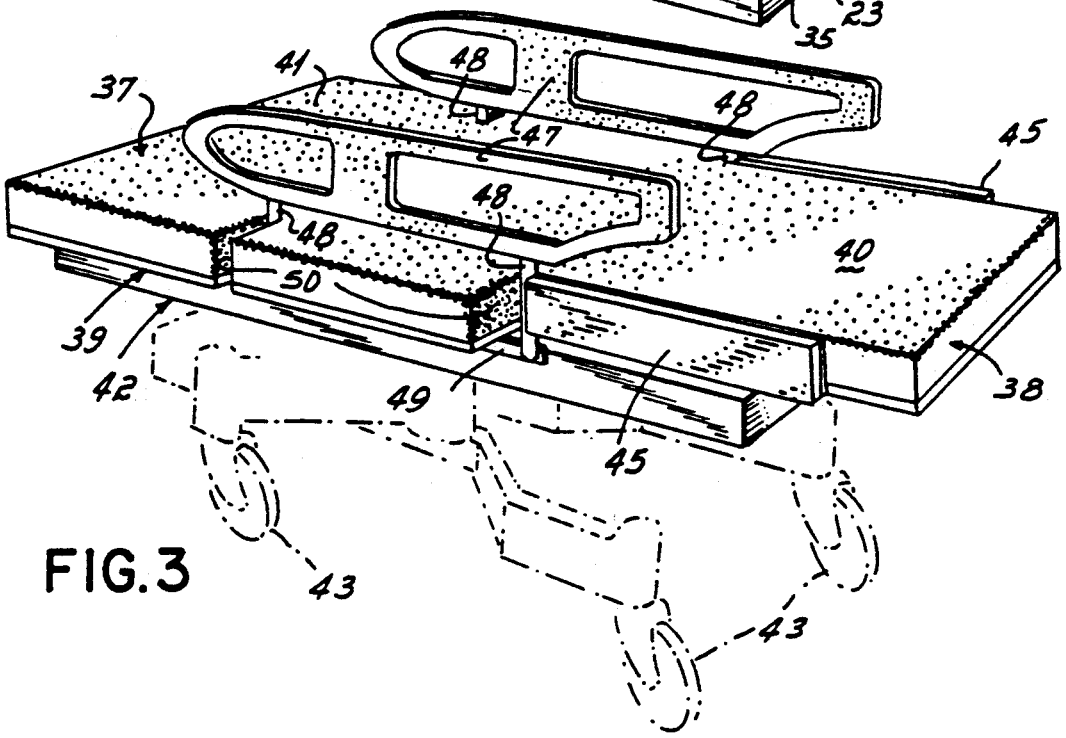
FIG. 3 is a diagrammatic perspective view of an alternative embodiment of the bed.

An alternative form of the invention is illustrated in FIG. 3. There, a patient support surface 37, including a mattress 38, supported on panels 39, has two articulating panels, namely, a head panel 40 and a seat and leg panel 41. The panels are mounted to a frame which is in turn mounted on a base 42 having casters 43 so that the bed can be moved from place to place. The head end panel 40 has collapsible side sections 45 which are substantially the same as the collapsible side sections described hereafter in connection with FIGS. 4 to 7. The bed has on each side a single long side guard 47. Each side guard is mounted on a pair of vertical posts 48. The vertical posts are mounted on a bar 49 which is in turn mounted for movement transversely inwardly to narrow the width of the bed. The parallelogram linkage of parent application Ser. No. 07/386,210 is a suitable form of support for the side guard. In order to permit movement inwardly, the mattress 40 has two vertical slots 50 aligned with the vertical posts 48, the slots permitting the posts 48 to move the side guards inwardly. When the side guards are moved inwardly, the width of the bed changes from a 42-inch width to a 34-inch width, the latter being a suitable width for transportation through doorways, down the halls, etc.

A mechanism by which the side sections can be inflated and deflated is illustrated in FIGS. 4 to 7.

The body support 12 has a rigid panel 65 which, at least at the head end of the bed, is preferably X-ray translucent so that a C-arm X-ray unit can be employed with the bed of the present invention. A thick, comfortable mattress 66 is mounted on top of the panel 65. To the extent that the bed is divided into plural body support sections, such as the head, seat, thigh, and leg sections, the panels and mattresses may be segmented.

The elongated, rigid wing or strip 35 is pivotally mounted on a manifold tube 69 secured by a bracket 70 to the panel 65. The wing 35 carries the bladder 36. The bladder is connected to plural inlet ports 76 spaced longitudinally along the generally circular cross-section hinge 77. A plurality of outlet ports 78 are spaced longitudinally along the wing 35 adjacent its hinge. Each outlet port 78 is aligned with a cooperating plug 79 that is mounted on the bracket 70, the plug 79 entering the outlet port 78 to seal it closed when the wing 35 is in the horizontal attitude depicted in FIG. 4.

The manifold tube 69 is connected to a compressor system 80 and optionally a vacuum pump 81. The compressor system 80 is adapted to pump air into the bladder 36 by pumping air through the manifold 69. The air in the manifold 69 passes through the aligned ports in the manifold and circular hinge section 77, respectively, to fill the bladder rapidly.

Figure 6:
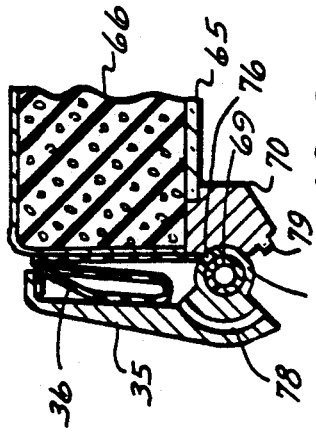
FIGS. 4, 5 and 6 are diagrammatic representations of the mechanism by which the side sections are inflated and deflated.
Figure 5:
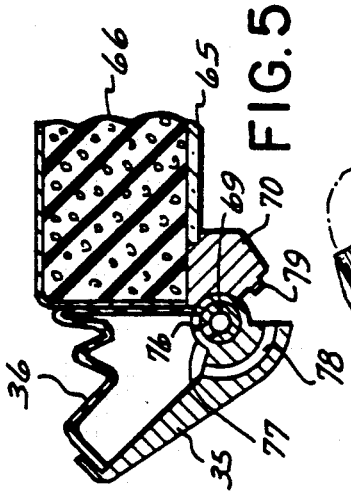
Figure 4:
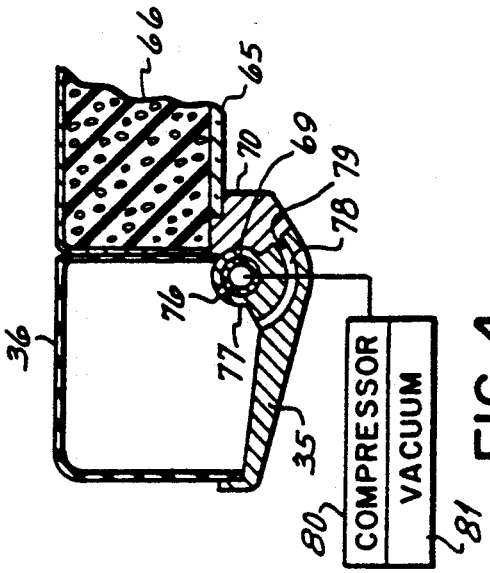

When the bladder 36 is to be vacated, the wings 35 are swung upwardly as depicted in FIGS. 5 and 6. As the upward swinging begins, the plug 79 in each port 78 exposes each port to atmosphere permitting the compressed air in the bladder to exhaust through the multiple ports. It may be desired to have a vacuum applied by means of a vacuum pump operating through the manifold 69 as a preliminary to the upward swinging of the wing 35.

In a preferred form of the invention, it is contemplated that when the head and/or foot guard 30, 31 is swung toward the bed to collapse the wings, as illustrated in FIG. 2, a switch (not shown) will be triggered that automatically effects the upward swinging of the wings 35 on both sides of the bed. Such a switch can be disabled by the nurse so that the head guard can be moved without collapsing the side sections.

Figure 7:
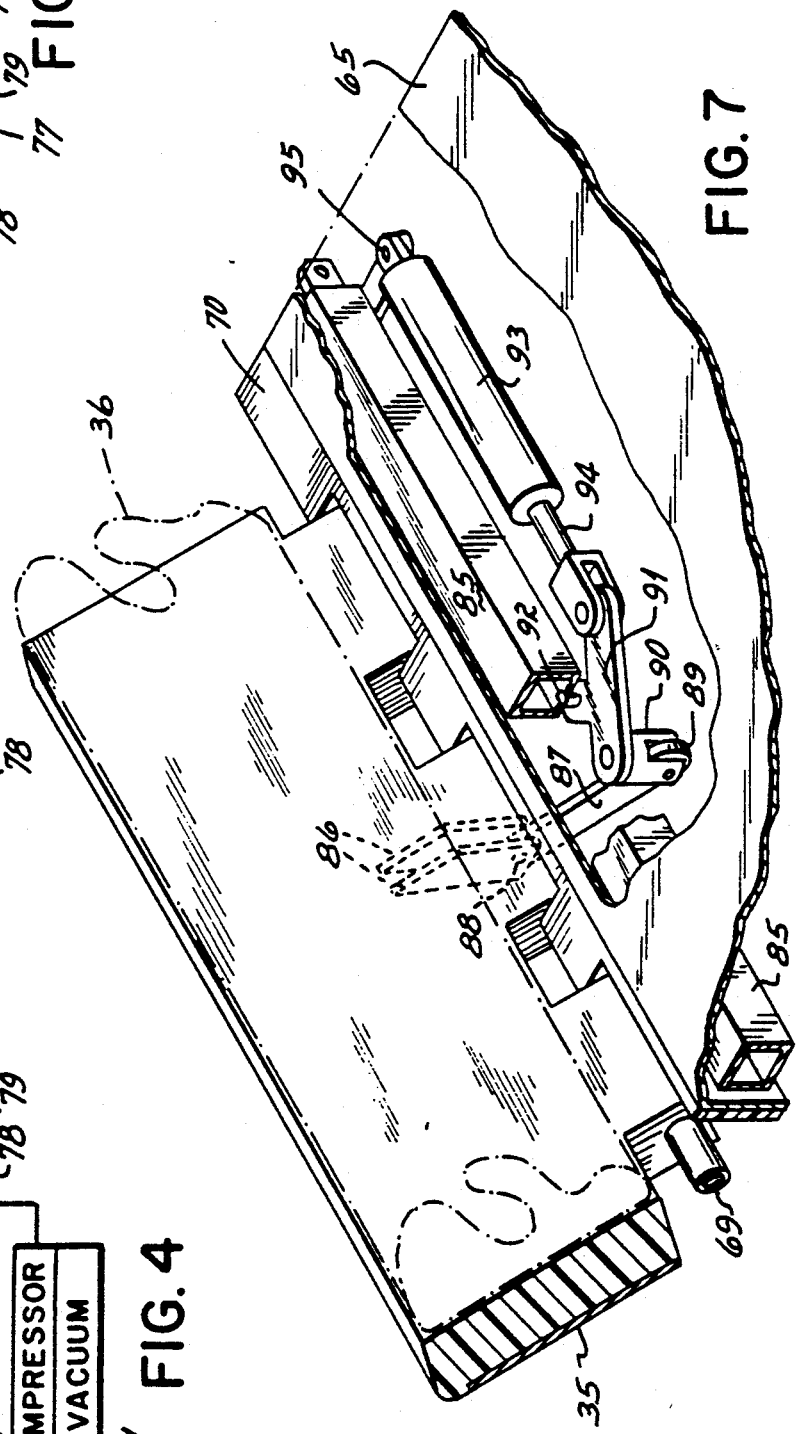
FIG 7 is a perspective view partially broken away of a head panel showing a preferred form of the mechanism, the side section being shown partially collapsed.

One form of mechanism for swinging the wings is illustrated in FIG. 7. As shown in FIG. 7, each panel has an aluminum tubular frame 85. The translucent panel 65 is secured to the frame. The wing 35 is hinged to the panel 65.

The wing 35 carries a pair of bracket arms 86. A lift arm link 87 is pivoted at one end 88 to the bracket 86. The other end 89 of the lift arm link is pivoted to a lower knuckle 90 which is pivoted to a pivot plate assembly 91. The pivot plate assembly 91 has a centrally located pivot axis 92 which is connected to the aluminum frame 85. A double-acting, hydraulic cylinder 93 has a rod 94 pivotally mounted to the other end of the pivot plate assembly 91. The hydraulic cylinder 93 is pivoted to the aluminum frame member at 95. When the hydraulic cylinder is operated to extend the rod 94, it swings the pivot plate assembly 91 which, through the knuckle 90 and lift arms 87, thrusts the wing 35 from a horizontal attitude to a vertical attitude as depicted in FIG. 6.

Figure 8:
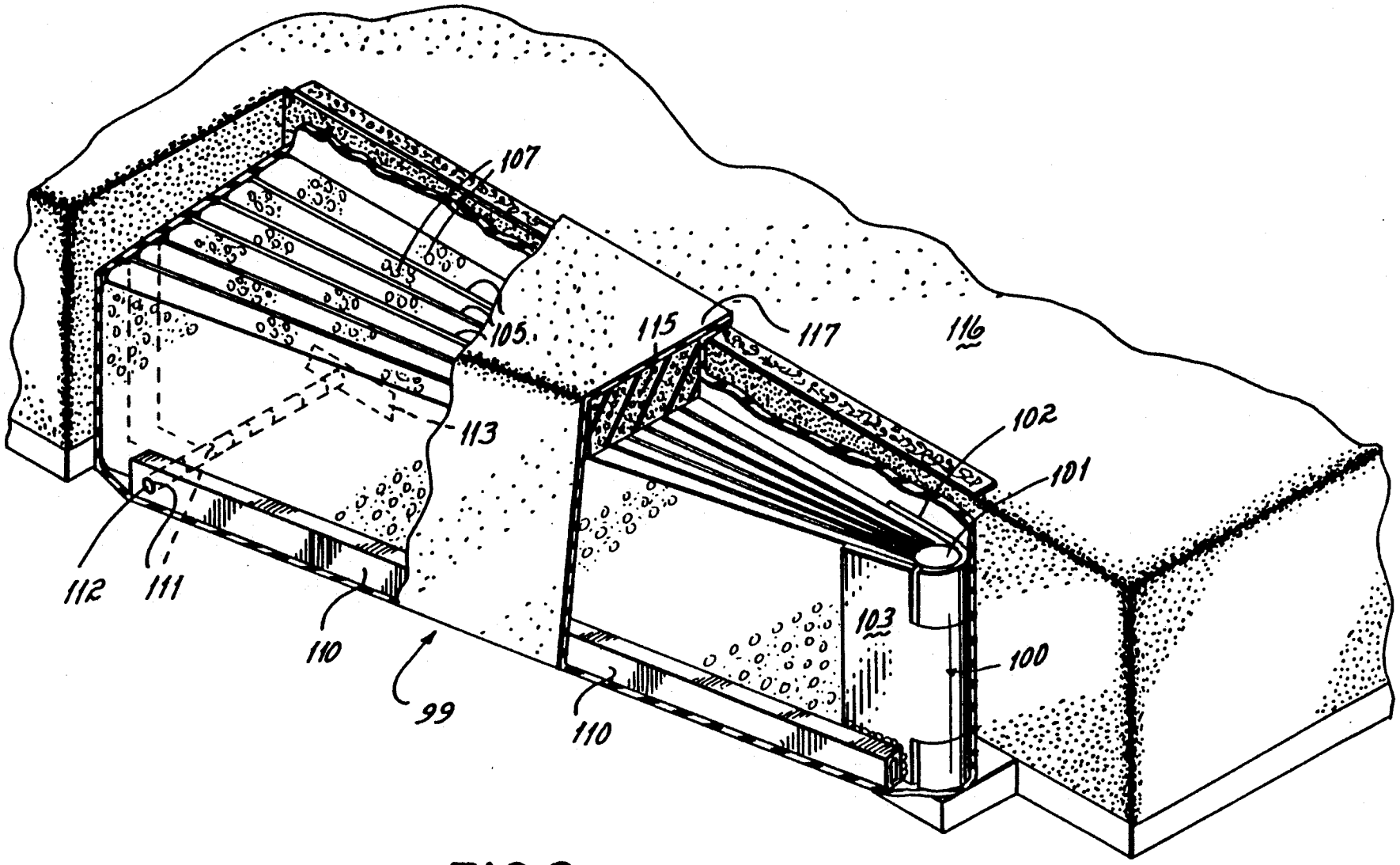
FIG. 8 is a diagrammatic, partially broken away, view of an alternative form of a collapsible side section.

An alternative form of collapsing side section 99 is shown in FIG. 8. A hinge 100 is mounted on a pintle 101 which is fixed to the patient support panel frame adjacent the free end of the head panel of the bed. The hinge has two plates 102, 103. Five semi-rigid, elongated vanes 105 of plastic sheet material are mounted between the plates 102 and 103 and are clamped together between them. Between adjacent vanes are triangular cross section, light-density urethane foam pads 107 which maintain the vanes spread apart from each other. An elongated reinforcing bar 110 is welded at one end to hinge plate 103 and extends the length of the side section 99. The reinforcing bar 110 preferably is 1" by ½" steel tube but, of course, can be any structural member.

The tube 110 and the vanes 105 have eyelets 111 on their lower edges. A post 112 is mounted to the bed frame 113 and projects through the eyelets. The eyelets thus stabilize the vanes and reinforcing bar and prevent their slipping downward under the stress of weight on top of the side section.

A light-density urethane foam block 115 of triangular cross section overlies the vanes and provides comfortable padding for the patient. The vanes 105, their spacers 107, and the overlying block 115 are all encased in a plastic sheath that matches the bed main mattress 116 in color. A bridging strip 117 of plastic sheath material is fixed to the side section 99 and extends over to the main mattress and is held there by a hook and loop fastener (Velcro) so that there is no discomfort arising out of the gap between the side section and the mattress.

In operation, the urethane foam pads collapse under pressure, thereby reducing the lateral dimension of the bed. Thus, for example, when a nurse, needing to reach across the patient, pushes against the side section with her stomach or chest, the side section will collapse, thereby bringing the nurse 4 to 5 inches closer to the far side of the bed.

Where the collapsing side section is utilized to reduce the width of the bed for transport, the inward thrust of a post supporting a side guard will collapse the collapsible side structure, thereby permitting the side guard to move inwardly to reduce the bed width about 4 inches on a side.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. In a hospital bed, a frame supporting a main mattress, a collapsible side section for said mattress comprising:

a hinge mounted on said frame, a plurality of vanes extending longitudinally from said hinge, triangular soft foam sections disposed between said vanes, and at least one triangular-shaped soft foam section overlying said vanes, whereby pressure on said vanes will collapse said triangular foam sections, thereby narrowing said hospital bed at said collapsible section.

2. A collapsible side section as in claim 1 further comprising:

a plastic skin wrapped around said vanes and foam, a strip of plastic extending from said skin to said main mattress to bridge the gap therebetween, and means for fastening said strip to said main mattress.

3. A collapsible side section as in claim 1 further comprising:

a rigid bracing strip mounted on the outermost vane and extending longitudinally the length of the outermost vane.

4. A collapsible side section as in claim 1 further comprising:

eyelets on the ends of said vanes remote from said hinge, and a guide post projecting laterally from said bed frame and projecting through said eyelets to support the free ends of said vanes.

* * * * *